US011185723B2

(12) United States Patent
Zanella, Jr.

(10) Patent No.: US 11,185,723 B2
(45) Date of Patent: Nov. 30, 2021

(54) BYPASS KNOB FOR BREATHING APPARATUS PRESSURE REGULATOR

(71) Applicant: MSA Technology, LLC, Cranberry Township, PA (US)

(72) Inventor: Mark Flori Zanella, Jr., Beaver, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 401 days.

(21) Appl. No.: 16/225,984

(22) Filed: Dec. 19, 2018

(65) Prior Publication Data

US 2020/0197732 A1 Jun. 25, 2020

(51) Int. Cl.

| | |
|---|---|
| ***A62B 9/02*** | (2006.01) |
| ***A62B 18/10*** | (2006.01) |
| ***A62B 7/04*** | (2006.01) |
| ***B63C 11/22*** | (2006.01) |

(52) U.S. Cl.

CPC ..... *A62B 9/027* (2013.01); *A62B 7/04* (2013.01); *A62B 18/10* (2013.01); *B63C 11/22* (2013.01)

(58) Field of Classification Search

CPC ..... B63C 11/22; B63C 11/2209; B63C 2011/2218; A62B 9/027; A62B 18/10; A62B 7/04; F16K 31/60

See application file for complete search history.

(56) References Cited

U.S. PATENT DOCUMENTS

| | | | | | |
|---|---|---|---|---|---|
| 3,441,115 | A * | 4/1969 | Gunther | F16K 31/60 | 464/36 |
| 3,699,998 | A * | 10/1972 | Baranowski, Jr. | G05D 16/0663 | 137/327 |
| 4,687,082 | A | 8/1987 | Lenfeldt | | |
| 4,789,000 | A * | 12/1988 | Aslanian | A61M 5/16881 | 137/556 |
| 4,802,506 | A * | 2/1989 | Aslanian | A61M 5/16881 | 137/556 |
| 4,807,660 | A * | 2/1989 | Aslanian | A61M 5/16881 | 137/382 |
| 5,005,604 | A * | 4/1991 | Aslanian | A61M 5/16881 | 137/556 |
| 6,328,280 | B1 | 12/2001 | Davidson | | |
| 8,025,053 | B1 | 9/2011 | Prete et al. | | |
| 2004/0250855 | A1* | 12/2004 | Hyde | G05D 16/0663 | 137/341 |

(Continued)

*Primary Examiner* — Timothy A Stanis
*Assistant Examiner* — Matthew R Moon
(74) *Attorney, Agent, or Firm* — The Webb Law Firm

(57) ABSTRACT

A bypass knob for a pressure regulator configured for use with a facemask of a breathing apparatus has a first member having a first engagement surface and a second member having a second engagement surface positioned opposite the first engagement surface. At least one slot is formed on the first engagement surface and at least one deflectable beam having a latch is formed on the second engagement surface of the second member. When the first member is rotated in a first direction about the longitudinal axis via a first rotational torque, the latch of the at least one deflectable beam is engaged with the at least one slot to rotate the second member with the first member, and disengaged when the first member is rotated in the first direction via a second rotational torque higher than the first rotational torque.

20 Claims, 8 Drawing Sheets

(56) References Cited

U.S. PATENT DOCUMENTS

| | | | | |
|---|---|---|---|---|
| 2008/0061256 | A1* | 3/2008 | Lewis | F16D 43/2028 251/77 |
| 2012/0179142 | A1* | 7/2012 | Abal | A61M 5/16804 604/537 |
| 2015/0059064 | A1* | 3/2015 | Klotz | A42B 3/324 2/417 |
| 2016/0153581 | A1* | 6/2016 | Giubertoni | F16K 31/60 137/553 |
| 2017/0136269 | A1* | 5/2017 | Jacotey | B64D 11/00 |

* cited by examiner

BYPASS KNOB FOR BREATHING APPARATUS PRESSURE REGULATOR

BACKGROUND OF THE DISCLOSURE

Field of the Disclosure

The present disclosure relates generally to breathing apparatuses, such as a self-contained breathing apparatus (SCBA), and in particular to a torque limiting and snap feedback bypass knob for a pressure regulator configured for use with an SCBA.

Description of the Related Art

In the field of firefighting, rescue operations, underwater activities, and other activities that occur in dangerous or specific environments, a breathing apparatus is often required in order to permit a person to safely and continually breathe. Accordingly, such a person will don and utilize a breathing apparatus, such as an SCBA, in a variety of contaminated or other irrespirable environments or conditions.

An SCBA often includes a frame that securely holds and supports one or more air tanks, with each air tank having an air hose that supplies air or oxygen to a facemask worn by the user. In particular, the air hose provides fluid communication between the air tank and the facemask through a pressure regulator, which regulates the pressure and flow of air or oxygen to the user based on respiration demand of the user. In some examples, the regulator may be attached or attachable to the facemask.

In some designs, a diaphragm divides the pressure regulator into an inner chamber having a pressure corresponding to the pressure within the facemask and an outer chamber having a pressure corresponding to the surrounding environment. The diaphragm is coupled to an actuating mechanism which opens and closes the inlet valve. The user's respiration creates a pressure differential between the inner and outer chambers of the regulator assembly which, in turn, causes displacement of the diaphragm thereby controlling (i.e., opening and closing) the inlet valve.

The pressure regulator may have a bypass assembly that allows for air from the tank to be delivered directly to the facemask, thereby bypassing the inlet valve. The bypass assembly is operable via a threaded knob between a fully open position, which bypasses the pressure regulating function of the diaphragm, and a fully closed position, which allows the regulating function of the diaphragm.

Existing bypass assemblies do not provide a positive feedback to indicate that the bypass assembly is fully closed. Furthermore, existing bypass assemblies are not configured for limiting the torque that can be applied to the threaded knob when twisting the threaded knob to the closed position. In view of these and other disadvantages of existing bypass assemblies, it is desirable to provide a pressure regulator with an improved bypass assembly.

SUMMARY OF THE DISCLOSURE

Therefore, and generally, the present disclosure provides an improved bypass assembly for use with a pressure regulator of a breathing apparatus that addresses or overcomes some or all of the drawbacks associated with known bypass assemblies. In particular, the present disclosure provides an improved bypass assembly for use with a pressure regulator of a breathing apparatus that provides feedback to the user when the bypass assembly is in a closed position. Furthermore, the present disclosure provides an improved bypass assembly for use with a pressure regulator of a breathing apparatus that limits the torque that can be applied to a bypass knob when engaging the bypass assembly to the closed position.

In some embodiments or aspects, provided is a bypass knob for a pressure regulator configured for use with a facemask of a breathing apparatus. The bypass knob may have a first member having a first engagement surface and a second member having a second engagement surface positioned opposite the first engagement surface. At least one slot may be provided on the first engagement surface of the first member, and at least one deflectable beam may be provided on the second engagement surface of the second member. The at least one deflectable beam may have a first end connected to the second member and a second, free end opposite the first end. The second end may have a latch protruding from the second engagement surface such that the latch is receivable within the at least one slot. The first member and the second member may be configured for rotating about a longitudinal axis. When the first member is rotated in a first direction about the longitudinal axis via a first rotational torque, the latch of the at least one deflectable beam may be engaged with the at least one slot to rotate the second member with the first member. When the first member is rotated in the first direction via a second rotational torque higher than the first rotational torque, the second end of the at least one deflectable beam may be deflected from a first, undeflected position to a second deflected position, whereby the latch is disengaged from the at least one slot such that the first member rotates relative to the second member.

In further embodiments or aspects, the latch may have an angled surface that engages a first edge or wall of the at least one slot when the latch is received within the at least one slot and when the first member is rotated in the first direction. The latch may have a normal surface opposite the angled surface. The normal surface may engage a second edge or wall of the at least one slot when the latch is received within the at least one slot and when the first member is rotated in a second direction opposite the first direction.

In further embodiments or aspects, the first engagement surface and the second engagement surface may be arranged substantially perpendicular to the longitudinal axis. The first member and the second member may be arranged coaxially with the longitudinal axis. The second member may have a hollow body with a proximal end spaced apart from a distal end along the longitudinal axis, with an inner cavity extending within the hollow body between the proximal end and the distal end. The hollow body may have a radially outwardly protruding projection between the proximal end and the distal end. The second engagement surface may be defined on the projection. The projection may have at least one opening extending therethrough, and the first end of the at least one deflectable beam may be connected to a sidewall of the at least one opening. A locking ring may be positioned within a groove on an inner surface of the hollow body. The locking ring may be configured for retaining the second member in a fixed axial position relative to the first member. The locking ring may be a snap ring.

In further embodiments or aspects, a self-contained breathing apparatus (SCBA) may have at least one air tank having at least one air hose extending therefrom, a pressure regulator assembly having a bypass assembly in fluid communication with the at least one air tank via the at least one air hose, and a facemask connected to the pressure regulator and configured for removable attachment to a head of a user. The bypass assembly may have a bypass housing and a bypass knob. The bypass knob may have a first member having a first engagement surface and a second member having a second engagement surface positioned opposite the first engagement surface. At least one slot may be provided on the first engagement surface of the first member, and at least one deflectable beam may be provided on the second engagement surface of the second member. The at least one deflectable beam may have a first end connected to the second member and a second, free end opposite the first end. The second end may have a latch protruding from the second engagement surface such that the latch is receivable within the at least one slot. The first member and the second member may be configured for rotating about a longitudinal axis. When the first member is rotated in a first direction about the longitudinal axis via a first rotational torque, the latch of the at least one deflectable beam may be engaged with the at least one slot to rotate the second member with the first member. When the first member is rotated in the first direction via a second rotational torque higher than the first rotational torque, the second end of the at least one deflectable beam may be deflected from a first, undeflected position to a second deflected position, whereby the latch is disengaged from the at least one slot such that the first member rotates relative to the second member.

In further embodiments or aspects, the bypass housing may have a bypass inlet, a bypass outlet, a fluid passage extending between the bypass inlet and the bypass outlet, and a rod configured to engage a piston of a valve assembly of the pressure regulator to regulate a passage of air from the at least one air tank through the pressure regulator. Rotation of the bypass knob may adjust a rate of air flow through the bypass assembly.

In further embodiments or aspects, the latch may have an angled surface that engages a first edge or wall of the at least one slot when the latch is received within the at least one slot and when the first member is rotated in the first direction. The latch may have a normal surface opposite the angled surface. The normal surface may engage a second edge or wall of the at least one slot when the latch is received within the at least one slot and when the first member is rotated in a second direction opposite the first direction.

In further embodiments or aspects, a pressure regulator assembly for a facemask of a self-contained breathing apparatus may have a housing defining a first chamber in fluid communication with an inlet and a second chamber in fluid communication with an outlet, and a valve assembly disposed between the first chamber and the second chamber. A bypass assembly may be connected to the housing and operatively engaged with the valve assembly. The bypass assembly may have a bypass housing and a bypass knob. The bypass knob may have a first member having a first engagement surface and a second member having a second engagement surface positioned opposite the first engagement surface. At least one slot may be provided on the first engagement surface of the first member, and at least one deflectable beam may be provided on the second engagement surface of the second member. The at least one deflectable beam may have a first end connected to the second member and a second, free end opposite the first end. The second end may have a latch protruding from the second engagement surface such that the latch is receivable within the at least one slot. The first member and the second member may be configured for rotating about a longitudinal axis. When the first member is rotated in a first direction about the longitudinal axis via a first rotational torque, the latch of the at least one deflectable beam may be engaged with the at least one slot to rotate the second member with the first member. When the first member is rotated in the first direction via a second rotational torque higher than the first rotational torque, the second end of the at least one deflectable beam may be deflected from a first, undeflected position to a second deflected position, whereby the latch is disengaged from the at least one slot such that the first member rotates relative to the second member.

In further embodiments or aspects, the bypass housing may have a bypass inlet, a bypass outlet, a fluid passage extending between the bypass inlet and the bypass outlet, and a rod configured to engage a piston of a valve assembly of the pressure regulator to regulate a passage of air from the at least one air tank through the pressure regulator. Rotation of the bypass knob may adjust a rate of air flow through the bypass assembly.

In further embodiments or aspects, the latch may have an angled surface that engages a first edge or wall of the at least one slot when the latch is received within the at least one slot and when the first member is rotated in the first direction. The latch may have a normal surface opposite the angled surface. The normal surface may engage a second edge or wall of the at least one slot when the latch is received within the at least one slot and when the first member is rotated in a second direction opposite the first direction.

These and other features and characteristics of the present disclosure, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure. Hence, specific dimensions and other physical characteristics related to the embodiments disclosed herein are not to be considered as limiting. Further, it is to be understood that the disclosure may assume various alternative variations and step sequences, except where expressly specified to the contrary.

DETAILED DESCRIPTION OF THE PREFERRED EMBODIMENT(S)

Figure 1:
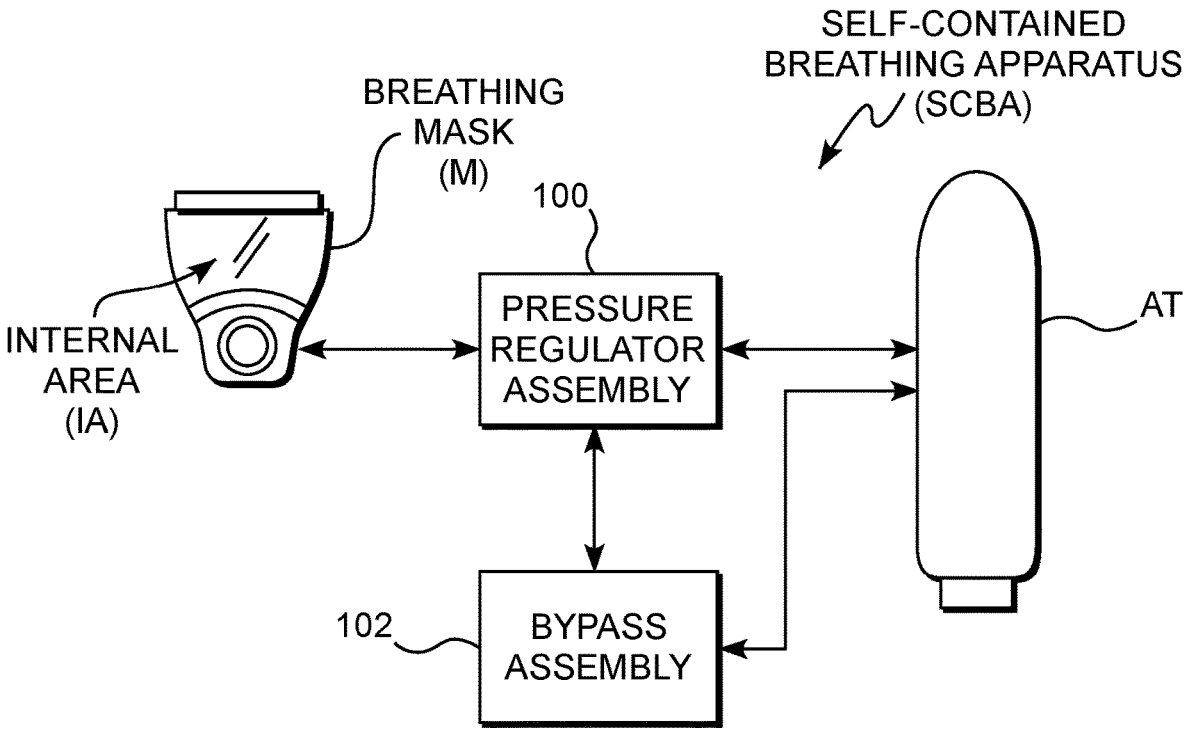
FIG. 1 is a schematic view of a self-contained breathing apparatus having a pressure regulator assembly and a bypass assembly according to some embodiments or aspects of the present disclosure.

As used in the specification and the claims, the singular form of "a", "an", and "the" include plural referents unless the context clearly dictates otherwise.

For purposes of the description hereinafter, the terms "end", "upper", "lower", "right", "left", "vertical", "horizontal", "top", "bottom", "lateral", "longitudinal" and derivatives thereof shall relate to the disclosure as it is oriented in the drawing figures. However, it is to be understood that the disclosure may assume various alternative variations and step sequences, except where expressly specified to the contrary.

All numbers and ranges used in the specification and claims are to be understood as being modified in all instances by the term "about". By "about" is meant plus or minus twenty-five percent of the stated value, such as plus or minus ten percent of the stated value. However, this should not be considered as limiting to any analysis of the values under the doctrine of equivalents.

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements.

The term "at least" is synonymous with "greater than or equal to".

As used herein, "at least one of" is synonymous with "one or more of". For example, the phrase "at least one of A, B, and C" means any one of A, B, or C, or any combination of any two or more of A, B, or C. For example, "at least one of A, B, and C" includes one or more of A alone; or one or more B alone; or one or more of C alone; or one or more of A and one or more of B; or one or more of A and one or more of C; or one or more of B and one or more of C; or one or more of all of A, B, and C.

The term "includes" is synonymous with "comprises".

As used herein, the terms "parallel" or "substantially parallel" mean a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values.

As used herein, the terms "perpendicular" or "substantially perpendicular" mean a relative angle as between two objects at their real or theoretical intersection is from 85° to 90°, or from 87° to 90°, or from 88° to 90°, or from 89° to 90°, or from 89.5° to 90°, or from 89.75° to 90°, or from 89.9° to 90°, inclusive of the recited values.

Figure 2:
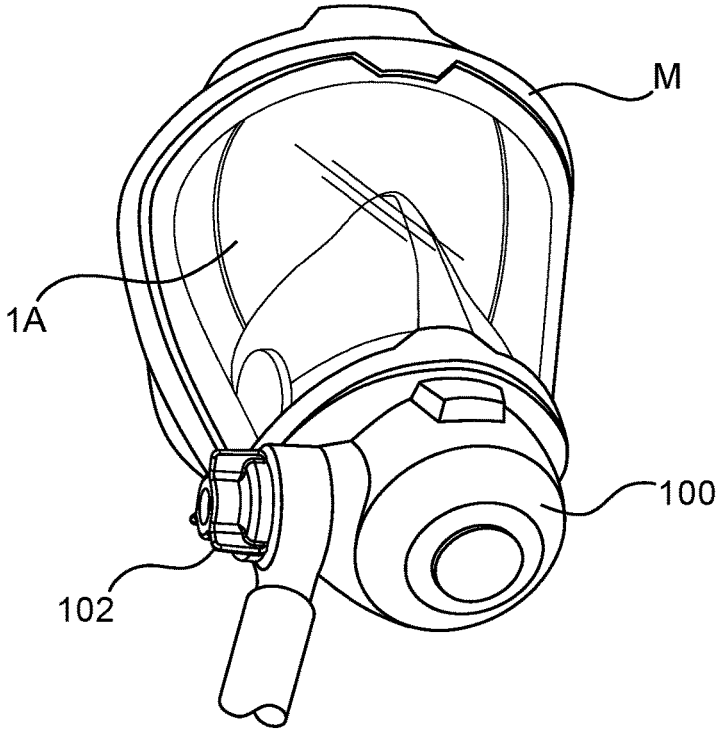
FIG. 2 is a front perspective view of a breathing mask having a pressure regulator assembly and a bypass assembly in accordance with some embodiments or aspects of the present disclosure.

As illustrated in schematic form in FIG. 1, the present disclosure is directed to a pressure regulator assembly 100 and a bypass assembly 102 for use with the pressure regulator assembly 100. The pressure regulator assembly 100 and the bypass assembly 102 may be configured for use with a self-contained breathing apparatus (SCBA). The SCBA includes at least one air tank (AT) configured or operable to deliver regulated air through an air hose and a breathing mask or helmet (M) configured to be worn by a user. As shown in FIG. 2, the breathing mask or helmet (M) includes the pressure regulator assembly 100 and the bypass assembly 102, which are configured to deliver air from the at least one air tank (AT) to an internal area (IA) of the breathing mask or helmet (M). The SCBA may be any SCBA available from Mine Safety Appliances Company (MSA) of Cranberry Township, Pennsylvania, such as MSA G1 SCBA.

Figure 3:
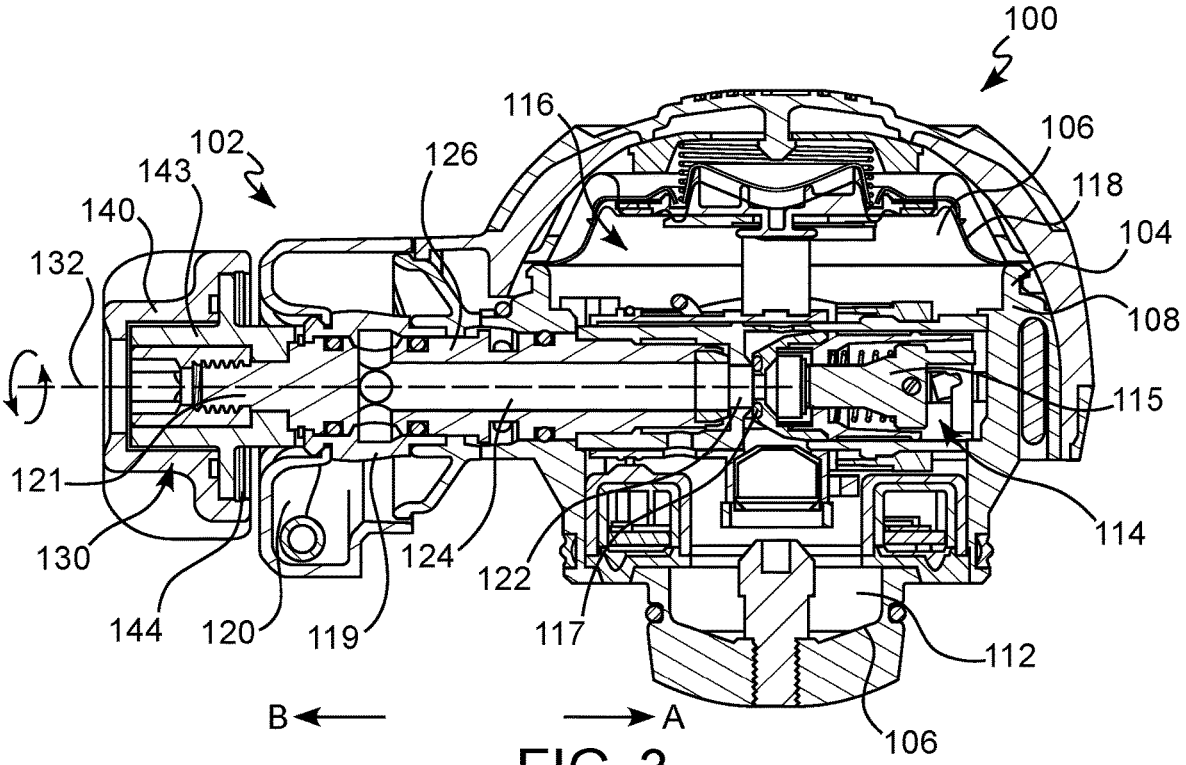
FIG. 3 is a side cross-sectional view of the pressure regulator assembly and the bypass assembly shown in FIG. 2.

With reference to FIG. 3, the pressure regulator assembly 100 includes an air inlet 104 that is configured for receiving air from an air source, such as the air tank (AT) shown in FIG. 1), and an air outlet 106 that is configured for delivering air to a desired destination source, such as the breathing mask or helmet (M). The pressure regulator assembly 100 further includes a housing 108 that defines an inlet chamber 110 in fluid communication with the air inlet 104, and an outlet chamber 112 in fluid communication with the air outlet 106. A valve assembly 114 is operatively positioned between the inlet chamber 110 and the outlet chamber 112, and is configured for selectively allowing air flow in a direction from the inlet chamber 110 toward the outlet chamber 112. The pressure regulator assembly 100 further includes a driving assembly 116 having a diaphragm 118 coupled to or operationally engaged with the valve assembly 114 in response to pressure change in the outlet chamber 112.

With continued reference to FIG. 3, the pressure regulator assembly 100 includes the bypass assembly 102. In some embodiments or aspects, the bypass assembly 102 is removably connectable or attachable to a suitable pressure regulator assembly 100, such as with a quick connect/disconnect mechanism. The bypass assembly 102 may be configured to act on at least a portion of the valve assembly 114, such as a piston 115 of the valve assembly 114, to thereby allow or facilitate air flow through the valve assembly 114 and into the outlet chamber 112 and the air outlet 106.

In some embodiments or aspects, the bypass assembly 102 facilitates the provision of constant and adjustable air flow (through the rotation of a rotatable bypass knob, as described herein), which flushes the breathing mask or helmet (M) and removes or eliminates fog on the faceshield. Furthermore, the bypass assembly 102 provides an emergency air source if the valve assembly 114 malfunctions (e.g., cannot be opened), thereby ensuring that the user can maintain normal breathing.

With continued reference to FIG. 3, the bypass assembly 102 includes a bypass housing 119 defining a bypass inlet 120, a bypass outlet 122, and a fluid passage 124 between the bypass inlet 120 and the bypass outlet 122. The bypass assembly 102 further includes a rod 126 positioned in the fluid passage 124. The rod 126 is movable within the fluid passage 124 by way of a threaded screw 121 formed at an end of the rod 126 that is engaged with a threaded portion of the bypass housing 119. The rod 126 is configured to selectively seal off the bypass outlet 122, thereby regulating the air flow to the valve assembly 114. In particular, the rod 126 is configured to move relative to the piston 115 of the valve assembly 114 to allow disengagement of the piston 115 from a sealing member 117 due to air in the fluid passage 124 acting on the piston 115.

With continued reference to FIG. 3, the bypass assembly 102 includes a rotatable bypass knob 130 operatively connected or coupled to the threaded screw 121 of the rod 126. The bypass knob 130 is rotatable about its longitudinal axis 132, which may be coaxial with a longitudinal axis of the rod 126. In particular, the bypass knob 130 is rotatable in a first direction (e.g., a counter-clockwise direction) and a second direction (e.g., a clockwise direction) about the longitudinal axis 132. Rotation of the bypass knob 130 in the first direction rotates the threaded screw 121, thereby urging the rod 126 in a direction toward the piston of the valve assembly 114 (shown by arrow A) to prevent disengagement of the piston 115 from a sealing member 117 due to air in the fluid passage 124 acting on the piston 115. Conversely, when the bypass knob 130 is rotated in the second direction, the rod 126 is urged in a direction away from the piston 115 of the valve assembly 114 (shown by arrow B) to allow disengagement of the piston 115 from the sealing member 117 due to air in the fluid passage 124 acting on the piston 115. The bypass knob 130 provides the user with the ability to adjust (or tune) the amount of air flow based upon the rotation of the bypass knob 130 in the first direction or second direction.

Figure 4:
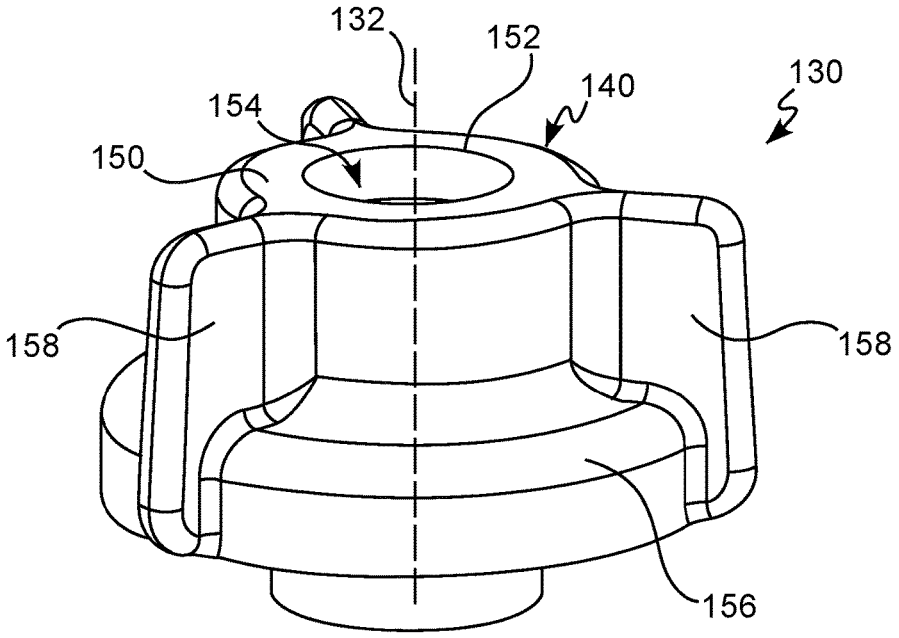
FIG. 4 is a perspective view of a bypass knob of a bypass assembly in accordance with some embodiments or aspects of the present disclosure.
Figure 5:
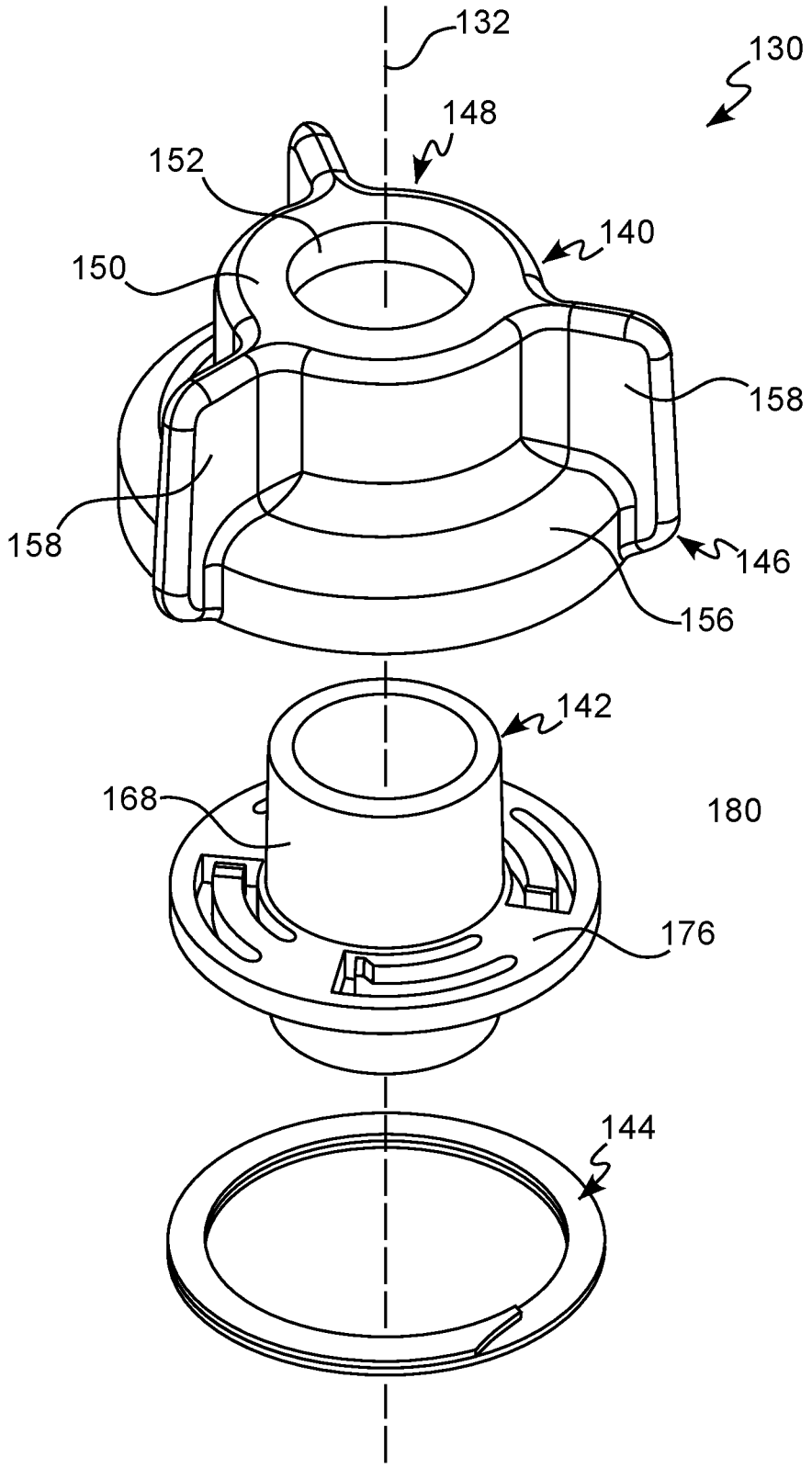
FIG. 5 is an exploded perspective view of the bypass knob shown in FIG. 4.

With reference to FIGS. 4-5, the bypass knob 130 is shown separately from the bypass assembly 102. As shown in FIG. 5, the bypass knob 130 has a first member 140 and a second member 142 received within at least a portion of the first member 140. A locking ring 144 retains the second member 142 in a fixed axial position relative to the first member 140, as described herein. The first member 140 and the second member 142 are arranged coaxially along the longitudinal axis 132. The longitudinal axis 132 represents the longitudinal axis of the first member 140 and the second member 142 of the bypass knob 130. In some embodiments or aspects, the locking ring 144 may be a snap ring that is removably connectable to at least a portion of the first member 140.

With continued reference to FIG. 5, the first member 140 has a proximal end 146 positioned opposite a distal end 148 in a direction along the longitudinal axis 132. As used herein, the proximal end 146 is an end of the first member 140 that is closest to the bypass housing 119, while the distal end 148 refers to an end of the first member 140 that is furthest away from the bypass housing 119 when the first member 140 is installed on the bypass housing 119 (see FIG. 3).

Figure 6A:
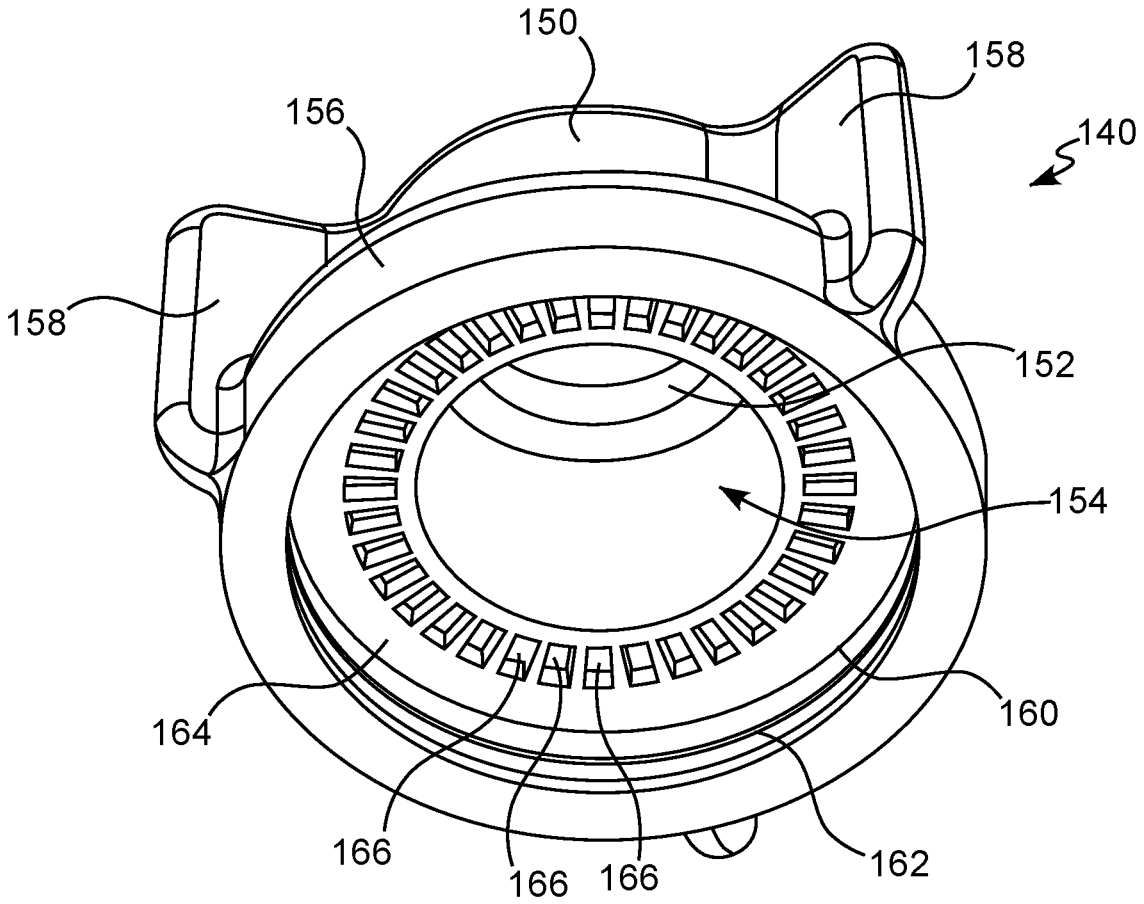
FIG. 6A is a bottom perspective view of a first member of the bypass knob shown in FIG. 5.

With reference to FIGS. 4 and 6A, the first member 140 has a first hollow body 150 with a first inner cavity 154 (shown in FIG. 6A) shaped and sized to receive at least a portion of the second member 142, as described herein. The first body 150 may have a central opening 152 at the distal end 148 that opens into the first inner cavity 154. In some embodiments or aspects, the first body 150 has a flange 156 that protrudes in a radially outward direction relative to the first body 150. The first body 150 may have a substantially circular cross-sectional shape having a first diameter, while the flange 156 may have a substantially circular cross-sectional shape having a second diameter different from the first diameter. In some embodiments or aspects, the first body 150 and the flange 156 may be monolithically formed together. In other embodiments or aspects, the first body 150 and the flange 156 may be formed separately and may be removably or non-removably connected together. The first body 150 and the flange 156 may have a substantially cylindrical form such that the diameters of the first body 150 and the flange 156 are constant along the longitudinal length of the first body 150 and the flange 156. In some embodiments or aspects, the first body 150 and the flange 156 may have a substantially conical form such that the diameters of the first body 150 and the flange 156 increase or decrease along the longitudinal length of the first body 150 and the flange 156. In further embodiments or aspects, the first body 150 and the flange 156 may have any other geometric shape, such as a square, oval, or a polygonal cross-sectional shape.

With continued reference to FIGS. 4 and 6A, the first member 140 has at least one gripping member 158 connected to the first body 150 and/or the flange 156. The at least one gripping member 158 protrudes from the first body 150 and/or the flange 156 in a direction radially away from the longitudinal axis 132. A plurality of gripping members 158 may be provided with equal or unequal angular spacing between adjacent gripping members 158 about the longitudinal axis 132. Each gripping member 158 is configured for providing a gripping surface such that the first member 140 can be easily rotated about the longitudinal axis 132, even while wearing gloves. In some embodiments, at least one surface of the at least one gripping member 158 may have a textured coating or a textured surface (not shown) for increasing the grip between the user's fingers and the first member 140.

With reference to FIG. 6A, an inner surface 160 of the flange 156 has a groove 162 that extends into the flange 156. In some embodiments or aspects, the groove 162 is continuous and extends circumferentially around the entire inner surface 160 of the flange 156. In other embodiments or aspects, the groove 162 may extend around a portion of the inner surface 160 of the flange 156. The groove 162 is configured to receive at least a portion of the locking ring 144 (shown in FIG. 5). In this manner, once at least a portion of the locking ring 144 is inserted into the groove 162, the locking ring 144 prevents the second member 142 from separating from the first member 140.

Figure 6B:
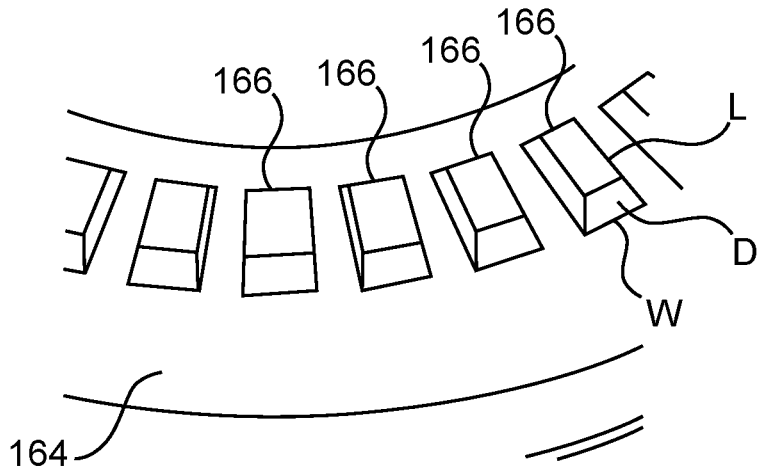
FIG. 6B is a detailed view of FIG. 6A.

With continued reference to FIG. 6A, the first member 140 has a first engagement surface 164 that is arranged substantially perpendicular to the longitudinal axis 132. In some embodiments or aspects, the first engagement surface 164 may be planar. The first engagement surface 164 is configured to engage at least a portion of the second member 142, as described herein. In some embodiments or aspects, the first engagement surface 164 has at least one slot 166. In some embodiments or aspects, the first engagement surface may have a plurality of slots 166 spaced apart from each other in a circumferential direction about the longitudinal axis 132. Each of the slots 166 is configured for receiving at least one latch of the second member 144. The slots 166 may have equal or unequal angular separation therebetween in a direction about the longitudinal axis 132. All of the slots 166 may have an identical shape. In some embodiments or aspects, at least some of the slots 166 may have a shape that is different from other slots 166, with each of the slots 166 being configured to receive the at least one latch of the second member 144. With reference to FIG. 6B, the slots 166 may have a length L and a width W, each of which is slightly larger than the width and length of the at least one latch of the second member 144. The slots 166 also have a depth D that is configured to receive the at least one latch of the second member 144, as described herein.

Figure 7A:
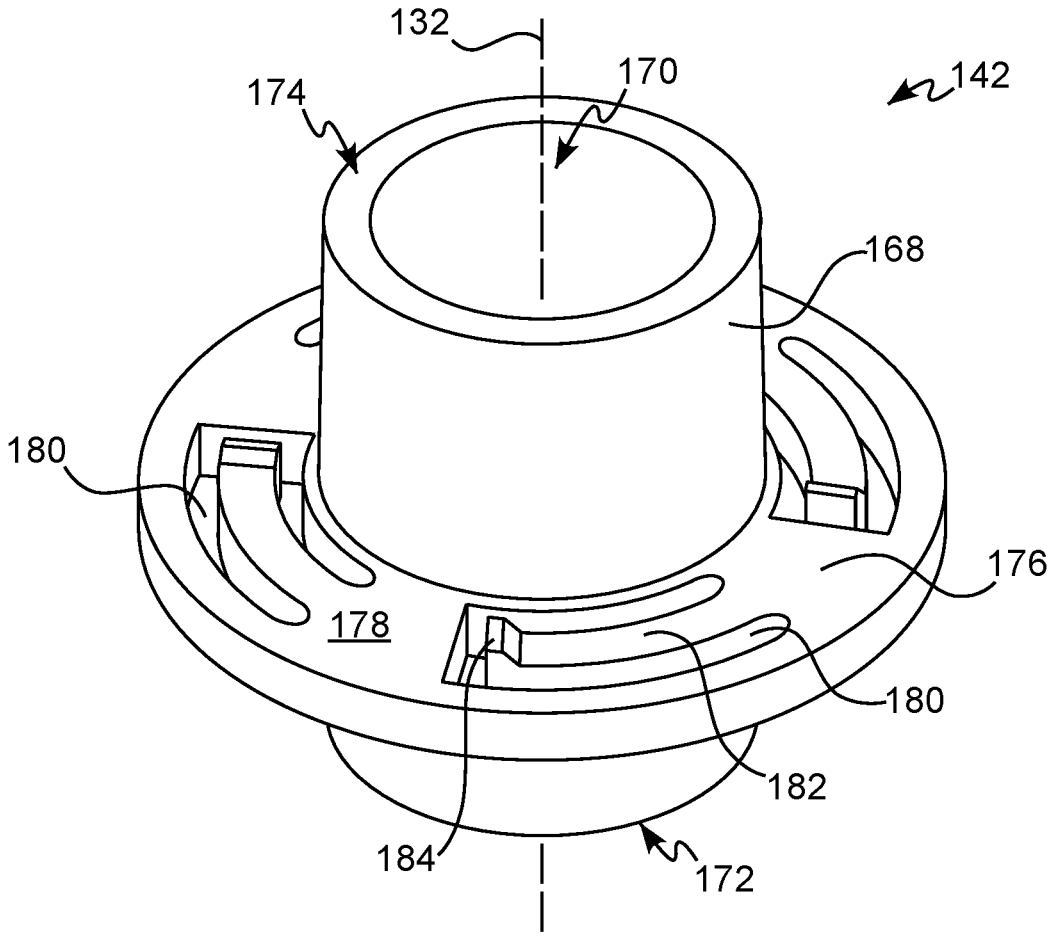
FIG. 7A is a top perspective view of a second member of the bypass knob shown in FIG. 5.

Referring to FIG. 7A, the second member 142 has a second hollow body 168 having a second inner cavity 170 extending therethrough between a proximal end 172 and a distal end 174 in a direction along the longitudinal axis 132. As used herein, the proximal end 172 is an end of the second member 142 that is closest to the bypass housing 119, while the distal end 174 refers to an end of the second member 142 that is furthest away from the bypass housing 119 when the second member 142 is installed on the bypass housing 119. The second body 168, at its distal end 174 is sized and shaped to be received within the first inner cavity 154 of the first member 140. The second body 168 may have a substantially circular cross-sectional shape and may have a substantially cylindrical form such that the diameter of the second body 168 is substantially constant along the longitudinal length of the second body 168. In some embodiments or aspects, the second body 168 may have a substantially conical form such that the diameter of the second body 168 increases or decreases along the longitudinal length of the second body 168. In further embodiments or aspects, the second body 168 may have any other geometric shape, such as a square, oval, or a polygonal cross-sectional shape that is configured to be received within the first inner cavity 154 of the first member 140.

Figure 8A:
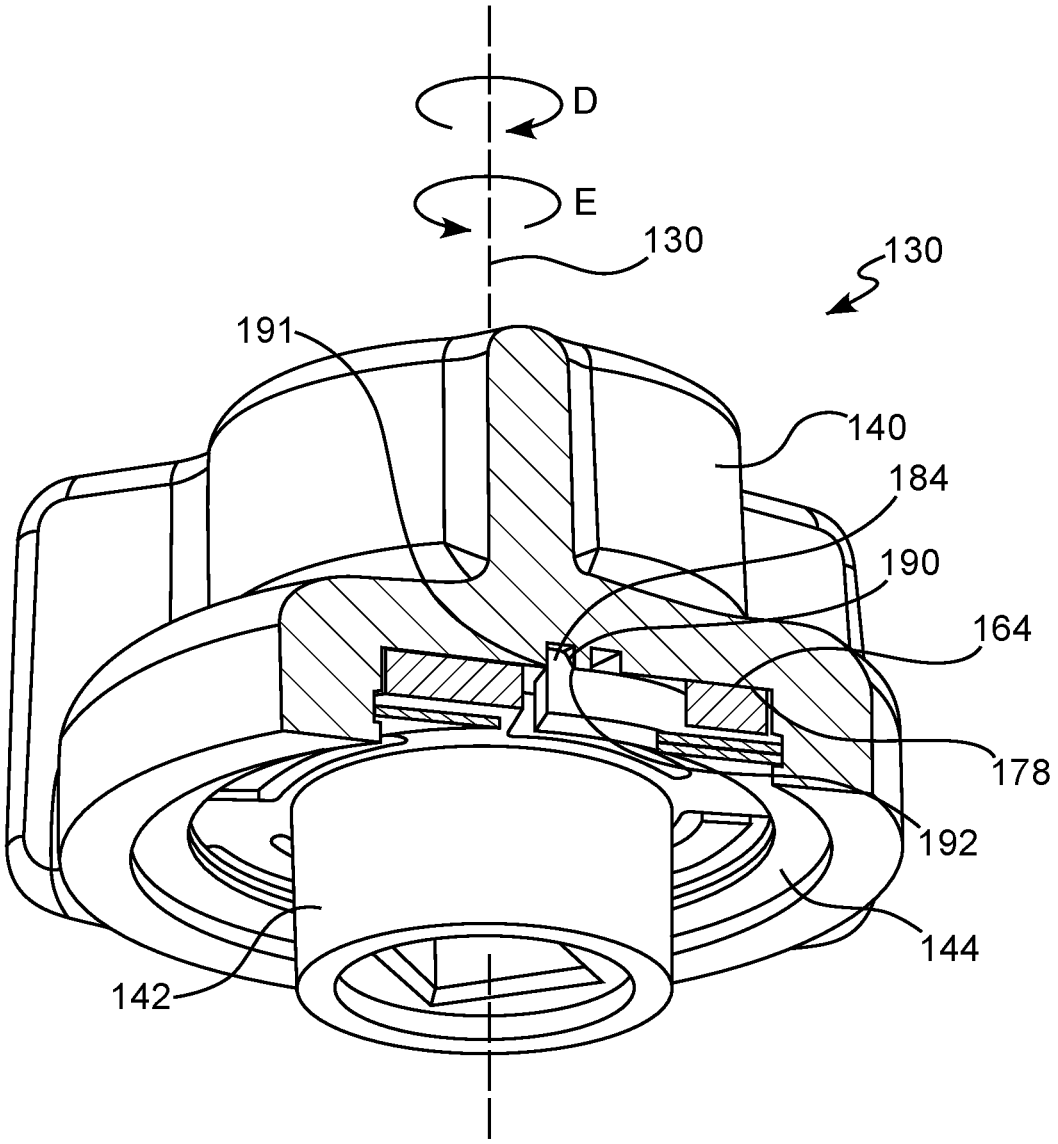
FIG. 8A is a partial cross-sectional view of the bypass knob shown in FIG. 4.
Figure 8B:
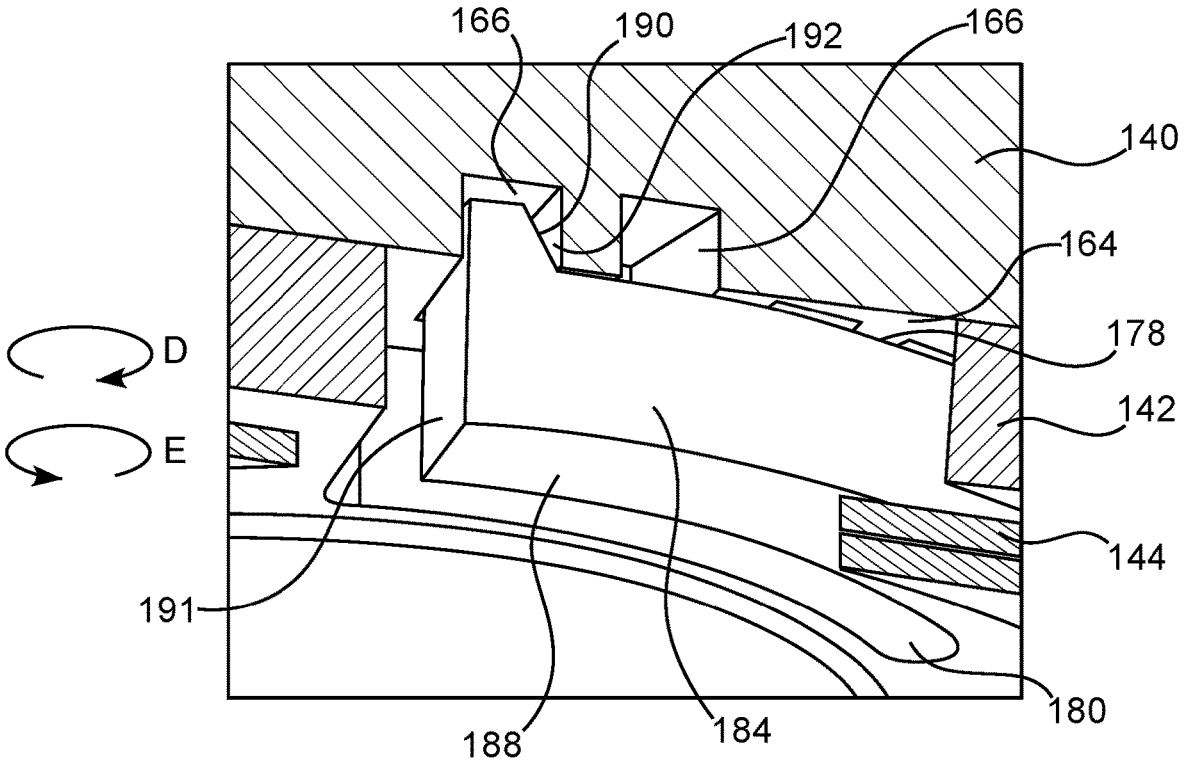
FIG. 8B is a detailed view of FIG. 8A with a deflectable beam shown in a first position.
Figure 8C:
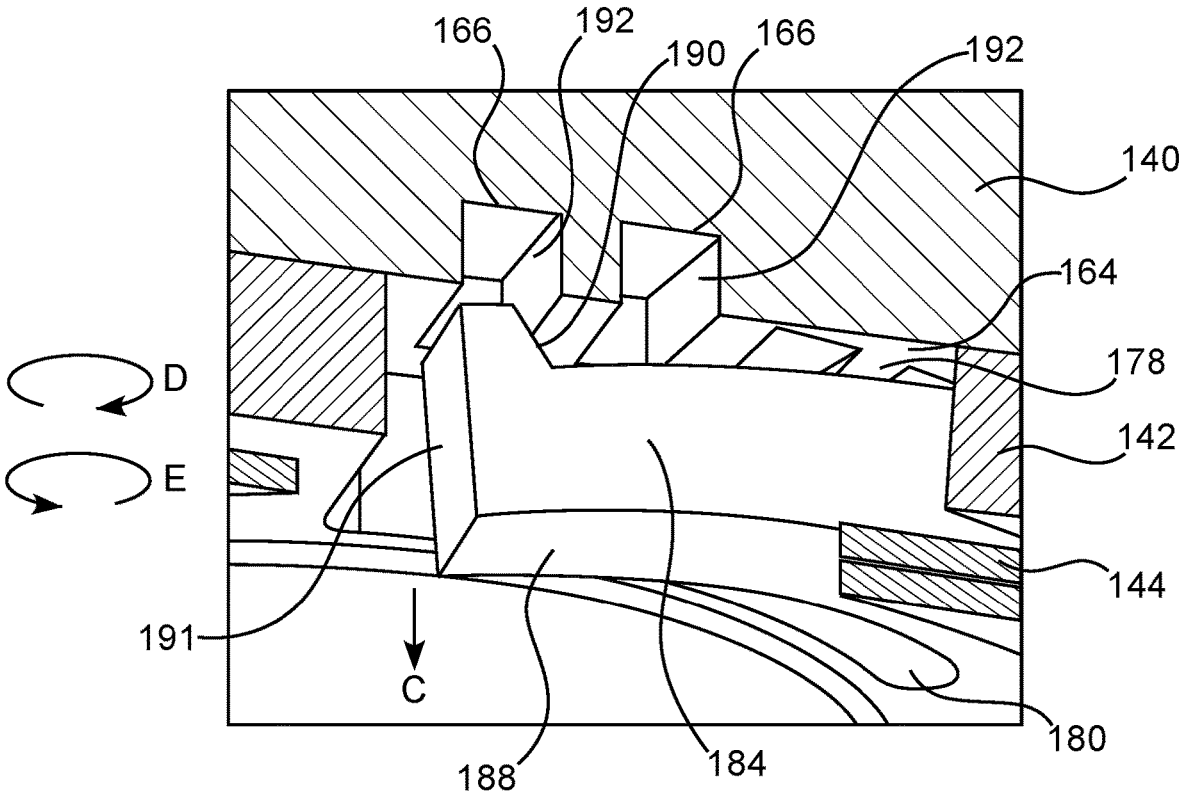
FIG. 8C is a detailed view of FIG. 8A with the deflectable beam shown in a second position.

With continued reference to FIG. 7A, the second body 168 has a projection 176 between the proximal end 172 and the distal end 174 that protrudes radially outward from an outer surface of the second body 168. The projection 176 may have a second engagement surface 178 that is configured for positioning across from the first engagement surface 164 when the first member 140 and the second member 142 of the bypass knob 130 are assembled together (see FIGS. 8A-8C). In some embodiments or aspects, the first engagement surface 164 and the second engagement surface 178 may be in direct physical contact with one another when the first member 140 and the second member 142 are assembled together (FIGS. 8A-8C). The projection 176 has at least one opening 180 extending therethrough. Each opening 180 has at least one deflectable beam 182 with a latch 184 configured for interacting with one or more of the slots 166 on the first member 140. The latch 184 is sized and shaped such that it can be received within any of the slots 166 on the first member 140.

Figure 7B:
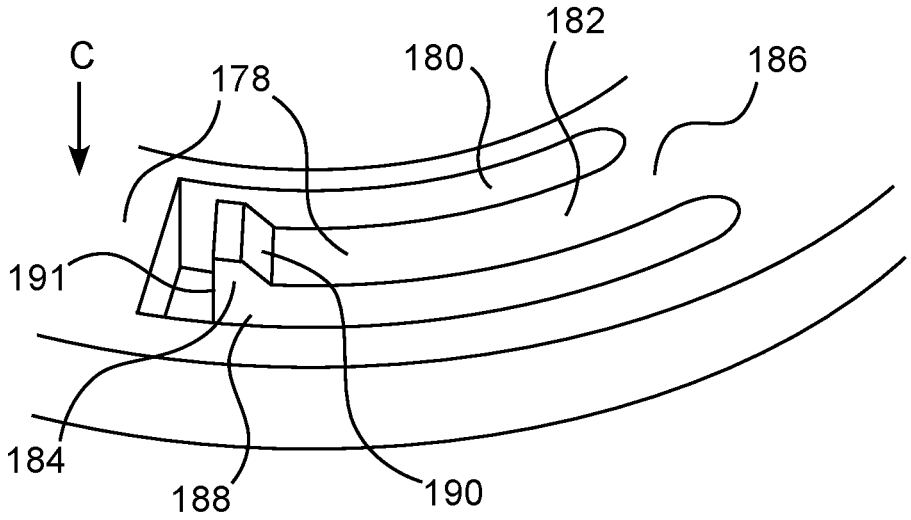
FIG. 7B is a detailed view of FIG. 7A.

With continued reference to FIG. 7A, the projection 176 may have a plurality of openings 180 spaced apart from each other at equal or unequal angular intervals about the longitudinal axis 132. Each opening 180 may have a curved shape or a linear shape. As shown in FIG. 7B, each opening 180 has at least one deflectable beam 182 having a first end 186 connected to a sidewall 188 of the opening 180 and a second, free end 188 opposite the first end 186. In this way, each deflectable beam 182 is arranged as a cantilever deflectable beam within the opening 180. In some embodiments or aspects, each opening 180 has one deflectable beam 182. The deflectable beams 182 may be shaped to correspond to the shape of the openings 180. For example, the deflectable beams 182 may have a curved shape that corresponds to the curved shape of the openings 180.

Figure 7C:
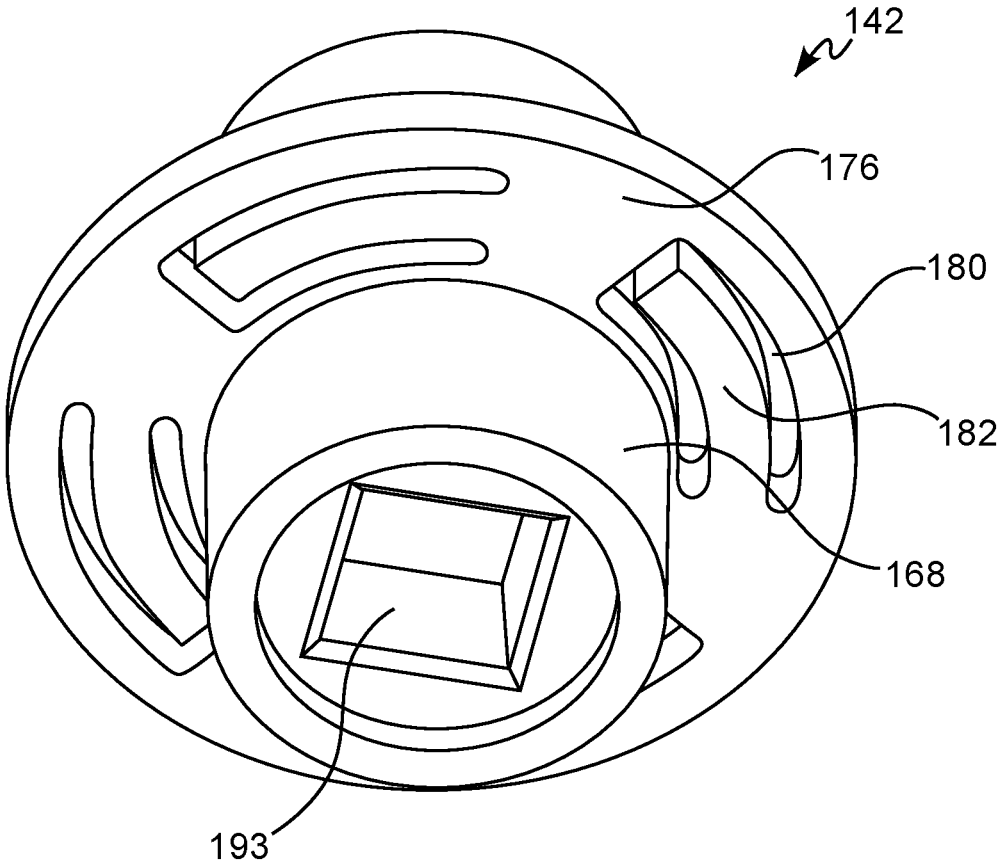
FIG. 7C is a bottom perspective view of the second member shown in FIG. 7A.

With continued reference to FIG. 7B, the second end 188 of each deflectable beam 182 has the latch 184 such that the latch 184 protrudes axially relative to the second engagement surface 178 of the projection 176 in a direction toward the distal end 174 of the second member 142. Each latch 184 has an angled surface 190 that is angled in a direction from the second end 188 toward the first end 186. The angled surface 190 is configured for engaging a sidewall of the slots 166, as described herein. In some embodiments or aspects, an angle $\alpha$ of the angled surface 190 may be 1° to 89° relative to the second engagement surface 178. Each latch 184 further has a normal surface 191 that is oriented substantially perpendicular to the second engagement surface 178. Each deflectable beam 182 is configured to deflect from a first, undeflected position toward a second, deflected position in a direction of arrow C. Each deflectable beam 182 is deflectable from the first position toward the second position due to interaction of the latch 184 with the slots 166 and the engagement surface 164 of the first member 140 during rotation of the first member 140 relative to the second member 142. With reference to FIG. 7C, the proximal end 172 of the second body 168 of the second member 142 has a keyed opening 193 configured for engaging the threaded screw 121 of the bypass housing 119 (shown in FIG. 3).

Having described the structure of the bypass knob 130 with reference to FIGS. 4-7C, a method of operating the bypass knob 130 via rotation of the bypass knob 130 in a first direction (i.e., in a clockwise direction about the longitudinal axis 132) indicated by arrow D or a second direction (i.e., in a counterclockwise direction about the longitudinal axis 132) indicated by arrow E will now be described with reference to FIGS. 8A-8C. Rotation of the bypass knob 130 is configured to operate the bypass assembly 102 between a closed position and an open position. For example, by rotating the bypass knob 130 in the first (clockwise) direction indicated by arrow D, the bypass assembly 102 may be operated to a closed position. Conversely, by rotating the bypass knob 130 in the second (counterclockwise) direction indicated by arrow E, the bypass assembly 102 may be operated to an open position. As described herein, the bypass knob 130 is configured to provide a torque limiting operation in the first direction such that the bypass knob 130 provides a positive feedback to the user that the bypass assembly 102 is closed.

With reference to FIG. 8A, to rotate the bypass knob 130 in the first (clockwise) direction, the user initially grasps the first member 140, such as by engaging the one or more gripping members 158 with fingers, and rotates the first member 140 in the direction of arrow D about the longitudinal axis 132 of the bypass knob 130. As shown in FIG. 8B, the first member 140 is engaged with the second member 142 such that the first engagement surface 164 of the first member 140 is positioned opposite the second engagement surface 178 of the second member 142. In some embodiments or aspects, the first engagement surface 164 and the second engagement surface 178 may be configured for sliding contact with each other to permit rotation of the first member 140 relative to the second member 142 when the input rotational torque on the first member 140 exceeds a predetermined threshold.

With reference to FIG. 8B, the latch 184 of each deflectable beam 182 is positioned within one of the slots 166 on the first engagement surface 164 of the first member 140. The angled surface 190 of the latch 184 is positioned within the slot 166 such that a base portion of the angled surface 190 proximate to the second engagement surface 178 contacts a first edge or wall 192 of the slot 166. Due to this direct physical contact between the angled surface 190 and the first edge or wall 192 of the slot 166, rotation of the first member 140 about the longitudinal axis 132 also causes the second member 142 to rotate. Because the second member 142 is connected to the threaded screw 121 (shown in FIG. 3), such rotation of the second member 142 also causes the threaded screw 121 to rotate in the first (clockwise) direction about the longitudinal axis 132, thereby moving the rod 126 bypass assembly 102 toward the closed position.

With continued reference to FIG. 8B, as the threaded screw 121 of the bypass assembly 102 is moved toward the closed position, there is a corresponding increase in effort or rotational torque necessary to rotate the first member 140 in the first (clockwise direction) of arrow D. At this rotational torque, a resulting normal force that acts on the angled surface 190 has a downward force component that acts in a direction of arrow C. As the torque input increases, this downward force component overcomes the natural tendency of each deflectable beam 182 to remain in the first, undeflected position and causes each deflectable beam 182 to deflect from its first or undeflected position toward a second or deflected position in the direction of arrow C (FIG. 8C). Such movement of the deflectable beam 182 occurs at a predetermined torque, such as a torque that must be exerted on the first member 140 to move the bypass assembly to a fully closed position. As each deflectable beam 182 is deflected, each latch 184 is moved out of its respective slot 166 due to a sliding movement of the angled surface 190 relative to the first edge or wall 192.

With reference to FIG. 8C, once each latch 184 is completely removed from the slot 166, an upper surface 194 of the latch 184 contacts the first engagement surface 164 of the first member 140. In this way, the first member 140 is effectively disengaged from the second member 142 such that rotation of the first member 140 in the first (clockwise direction) does not cause a corresponding rotation of the second member 142. Instead, the first member 140 rotates relative to the second member 142, thereby moving each latch 184 along the first engagement surface 164 until the latch 184 is moved to an adjacent slot 166, thereby causing each deflectable beam 182 to deflect from the second, deflected position to the first, undeflected position.

Continued rotation of the first member 140 in the first (clockwise) direction of arrow D after the bypass assembly 102 is moved to a fully closed position causes the first member 140 to freely rotate relative to the second member 142 due to continuous "skipping" or "snapping" of the deflectable beams 184 from one slot 166 into an adjacent slot 166. Such "skipping" or "snapping" of the deflectable beams 184 is configured to provide a positive feedback to the user that the bypass assembly 102 is in the fully closed position. This positive feedback may be via a tactile feedback that is felt through the first member 140 as the first member 140 is rotated relative to the second member 142. Alternatively, or in addition, the positive feedback may be an auditory feedback that can be heard by the user due to continuous "skipping" or "snapping" of the deflectable beams 184 within the slots 166.

With a rotation of the bypass knob 130 in the second (counterclockwise) direction indicated by arrow E, the latch 184 of each deflectable beam 182 is positioned within one of the slots 166 on the first engagement surface 164 of the first member 140 such that the normal surface 191 of the latch 184 contacts a second edge or wall 194 of the slot 166 that is positioned opposite the first edge or wall 192. In this manner, rotation of the first member 140 about the longitudinal axis 132 in the direction of arrow E also causes the second member 142 to rotate due to engagement between the normal surface 191 of the latch 184 with the second edge or wall 194 of the slot 166. Because the second member 142 is connected to the threaded screw 121 (shown in FIG. 3), such rotation of the second member 142 also causes the threaded screw 121 to rotate in the second (counterclockwise) direction about the longitudinal axis 132, thereby moving the rod 126 of the bypass assembly 102 toward the open position. Due to the parallel arrangement of the normal surface 191 and the second edge or wall 194, there is no resulting force component that deflects the deflectable beams 184 from the slots 166 when the bypass knob 130 is rotated in the second (counterclockwise) direction indicated by arrow E.

In some embodiments or aspects, the first member and the second member of the bypass knob may be manufactured in a molding process, such as an injection molding process, which provides a simplified part manufacture, reduces manufacturing costs, and reduces product weight.

While the bypass knob 130 has been described herein in terms of its use on a bypass assembly 102 of a pressure regulator for an SCBA, the use of the bypass knob 130 is not limited to such applications. For example, the bypass knob 130 may be used instead of any rotary-style knob where it is desired to have a positive indication that the knob is in a fully closed or a fully open position.

Further embodiments or aspects will now be described in the following numbered clauses.

Clause 1. A bypass knob for a pressure regulator configured for use with a facemask of a breathing apparatus, the bypass knob comprising: a first member having a first engagement surface; a second member having a second engagement surface positioned opposite the first engagement surface; at least one slot on the first engagement surface of the first member; and at least one deflectable beam on the second engagement surface of the second member, the at least one deflectable beam having a first end connected to the second member and a second, free end opposite the first end, wherein the second end has a latch protruding from the second engagement surface such that the latch is receivable within the at least one slot, wherein the first member and the second member are configured for rotating about a longitudinal axis, wherein, when the first member is rotated in a first direction about the longitudinal axis via a first rotational torque, the latch of the at least one deflectable beam is engaged with the at least one slot to rotate the second member with the first member, and wherein, when the first member is rotated in the first direction via a second rotational torque higher than the first rotational torque, the second end of the at least one deflectable beam is deflected from a first, undeflected position to a second deflected position whereby the latch is disengaged from the at least one slot such that the first member rotates relative to the second member.

Clause 2. The bypass knob of clause 1, wherein the latch has an angled surface that engages a first edge or wall of the at least one slot when the latch is received within the at least one slot and when the first member is rotated in the first direction.

Clause 3. The bypass knob of clause 1 or 2, wherein the latch has a normal surface opposite the angled surface, and wherein the normal surface engages a second edge or wall of the at least one slot when the latch is received within the at least one slot and when the first member is rotated in a second direction opposite the first direction.

Clause 4. The bypass knob of any of clauses 1-3, wherein the first engagement surface and the second engagement surface are arranged substantially perpendicular to the longitudinal axis.

Clause 5. The bypass knob of any of clauses 1-4, wherein the first engagement surface is planar.

Clause 6. The bypass knob of any of clauses 1-5, wherein the second engagement surface is planar.

Clause 7. The bypass knob of any of clauses 1-6, wherein the first engagement surface is in direct physical contact with at least a portion of the second engagement surface.

Clause 8. The bypass knob of any of clauses 1-7, wherein the at least one slot is a plurality of slots spaced apart from each other about the longitudinal axis.

Clause 9. The bypass knob of any of clauses 1-8, wherein the first member has a first hollow body with a proximal end spaced apart from a distal end along the longitudinal axis, with a first inner cavity extending within the first hollow body between the proximal end and the distal end.

Clause 10. The bypass knob of any of clauses 1-9, wherein at least a portion of the second member is received within the first inner cavity of the first member.

Clause 11. The bypass knob of any of clauses 1-10, wherein the first member has a flange that protrudes in a radially outward direction relative to the first hollow body at the proximal end.

Clause 12. The bypass knob of any of clauses 1-11, further comprising at least one gripping member protruding radially outward relative to an outer surface of the hollow body.

Clause 13. The bypass knob of any of clauses 1-12, wherein the first member and the second member are arranged coaxially with the longitudinal axis.

Clause 14. The bypass knob of any of clauses 1-13, wherein the second member has a hollow body with a proximal end spaced apart from a distal end along the longitudinal axis, with an inner cavity extending within the hollow body between the proximal end and the distal end.

Clause 15. The bypass knob of any of clauses 1-14, wherein the hollow body has a radially outwardly protruding projection between the proximal end and the distal end, and wherein the second engagement surface is defined on the projection.

Clause 16. The bypass knob of any of clauses 1-15, wherein the projection has at least one opening extending therethrough, and wherein the first end of the at least one deflectable beam is connected to a sidewall of the at least one opening.

Clause 17. The bypass knob of any of clauses 1-16, wherein the proximal end of the hollow body has a keyed opening configured for engaging a threaded screw of a bypass assembly.

Clause 18. The bypass knob of any of clauses 1-17, further comprising a locking ring positioned within a groove on an inner surface of the hollow body, wherein the locking ring is configured for retaining the second member in a fixed axial position relative to the first member.

Clause 19. The bypass knob of any of clauses 1-18, wherein the locking ring is a snap ring.

Clause 20. A self-contained breathing apparatus (SCBA) comprising: at least one air tank having at least one air hose extending therefrom; a pressure regulator assembly having a bypass assembly in fluid communication with the at least one air tank via the at least one air hose; and a facemask connected to the pressure regulator and configured for removable attachment to a head of a user, wherein the bypass assembly comprises a bypass housing and a bypass knob, the bypass knob comprising: a first member having a first engagement surface; a second member having a second engagement surface positioned opposite the first engagement surface; at least one slot on the first engagement surface of the first member; and at least one deflectable beam on the second engagement surface of the second member, the at least one deflectable beam having a first end connected to the second member and a second, free end opposite the first end, wherein the second end has a latch protruding from the second engagement surface such that the latch is receivable within the at least one slot, wherein the first member and the second member are configured for rotating about a longitudinal axis, wherein, when the first member is rotated in a first direction about the longitudinal axis via a first rotational torque, the latch of the at least one deflectable beam is engaged with the at least one slot to rotate the second member with the first member, and wherein, when the first member is rotated in the first direction via a second rotational torque higher than the first rotational torque, the second end of the at least one deflectable beam is deflected from a first, undeflected position to a second deflected position whereby the latch is disengaged from the at least one slot such that the first member rotates relative to the second member.

Clause 21. The SCBA of clause 20, wherein the bypass housing has a bypass inlet, a bypass outlet, a fluid passage extending between the bypass inlet and the bypass outlet, and a rod configured to engage a valve assembly of the pressure regulator to regulate a passage of air from the at least one air tank through the pressure regulator.

Clause 22. The SCBA of clause 20 or 21, wherein rotation of the bypass knob adjusts a rate of air flow through the bypass assembly.

Clause 23. The SCBA of any of clauses 20-22, wherein the latch has an angled surface that engages a first edge or wall of the at least one slot when the latch is received within the at least one slot and when the first member is rotated in the first direction.

Clause 24. The SCBA of any of clauses 20-23, wherein the latch has a normal surface opposite the angled surface, and wherein the normal surface engages a second edge or wall of the at least one slot when the latch is received within the at least one slot and when the first member is rotated in a second direction opposite the first direction.

Clause 25. The SCBA of any of clauses 20-24, wherein the first engagement surface and the second engagement surface are arranged substantially perpendicular to the longitudinal axis.

Clause 26. The SCBA of any of clauses 20-25, wherein the first engagement surface is planar.

Clause 27. The SCBA of any of clauses 20-26, wherein the second engagement surface is planar.

Clause 28. The SCBA of any of clauses 20-27, wherein the first engagement surface is in direct physical contact with at least a portion of the second engagement surface.

Clause 29. The SCBA of any of clauses 20-28, wherein the at least one slot is a plurality of slots spaced apart from each other about the longitudinal axis.

Clause 30. The SCBA of any of clauses 20-29, wherein the first member has a first hollow body with a proximal end spaced apart from a distal end along the longitudinal axis, with a first inner cavity extending within the first hollow body between the proximal end and the distal end.

Clause 31. The SCBA of any of clauses 20-30, wherein at least a portion of the second member is received within the first inner cavity of the first member.

Clause 32. The SCBA of any of clauses 20-31, wherein the first member has a flange that protrudes in a radially outward direction relative to the first hollow body at the proximal end.

Clause 33. The SCBA of any of clauses 20-32, further comprising at least one gripping member protruding radially outward relative to an outer surface of the hollow body.

Clause 34. The SCBA of any of clauses 20-33, wherein the first member and the second member are arranged coaxially with the longitudinal axis.

Clause 35. The SCBA of any of clauses 20-34, wherein the second member has a hollow body with a proximal end spaced apart from a distal end along the longitudinal axis, with an inner cavity extending within the hollow body between the proximal end and the distal end.

Clause 36. The SCBA of any of clauses 20-35, wherein the hollow body has a radially outwardly protruding projection between the proximal end and the distal end, and wherein the second engagement surface is defined on the projection.

Clause 37. The SCBA of any of clauses 20-36, wherein the projection has at least one opening extending therethrough, and wherein the first end of the at least one deflectable beam is connected to a sidewall of the at least one opening.

Clause 38. The SCBA of any of clauses 20-37, wherein the proximal end of the hollow body has a keyed opening configured for engaging a threaded screw of a bypass assembly.

Clause 39. The SCBA of any of clauses 20-38, further comprising a locking ring positioned within a groove on an inner surface of the hollow body, wherein the locking ring is configured for retaining the second member in a fixed axial position relative to the first member.

Clause 40. The SCBA of any of clauses 20-39, wherein the locking ring is a snap ring.

Clause 41. A pressure regulator assembly for a facemask of a self-contained breathing apparatus, the pressure regulator assembly comprising: a housing defining a first chamber in fluid communication with an inlet and a second chamber in fluid communication with an outlet; a valve assembly disposed between the first chamber and the second chamber; and a bypass assembly connected to the housing and operatively engaged with the valve assembly, the bypass assembly comprising a bypass housing and a bypass knob, the bypass knob comprising: a first member having a first engagement surface; a second member having a second engagement surface positioned opposite the first engagement surface; at least one slot on the first engagement surface of the first member; and at least one deflectable beam on the second engagement surface of the second member, the at least one deflectable beam having a first end connected to the second member and a second, free end opposite the first end, wherein the second end has a latch protruding from the second engagement surface such that the latch is receivable within the at least one slot, wherein the first member and the second member are configured for rotating about a longitudinal axis, wherein, when the first member is rotated in a first direction about the longitudinal axis via a first rotational torque, the latch of the at least one deflectable beam is engaged with the at least one slot to rotate the second member with the first member, and wherein, when the first member is rotated in the first direction via a second rotational torque higher than the first rotational torque, the second end of the at least one deflectable beam is deflected from a first, undeflected position to a second deflected position whereby the latch is disengaged from the at least one slot such that the first member rotates relative to the second member.

Clause 42. The pressure regulator assembly of clause 41, wherein the bypass housing has a bypass inlet, a bypass outlet, a fluid passage extending between the bypass inlet and the bypass outlet, and a rod configured to engage a valve assembly of the pressure regulator to regulate a passage of air from the at least one air tank through the pressure regulator.

Clause 43. The pressure regulator assembly of clause 41 or 42, wherein rotation of the bypass knob adjusts a rate of air flow through the bypass assembly.

Clause 44. The pressure regulator assembly of any of clauses 41-43, wherein the latch has an angled surface that engages a first edge or wall of the at least one slot when the latch is received within the at least one slot and when the first member is rotated in the first direction.

Clause 45. The pressure regulator assembly of any of clauses 41-44, wherein the latch has a normal surface opposite the angled surface, and wherein the normal surface engages a second edge or wall of the at least one slot when the latch is received within the at least one slot and when the first member is rotated in a second direction opposite the first direction.

Clause 46. The pressure regulator assembly of any of clauses 41-45, wherein the first engagement surface and the second engagement surface are arranged substantially perpendicular to the longitudinal axis.

Clause 47. The pressure regulator assembly of any of clauses 41-46, wherein the first engagement surface is planar.

Clause 48. The pressure regulator assembly of any of clauses 41-47, wherein the second engagement surface is planar.

Clause 49. The pressure regulator assembly of any of clauses 41-48, wherein the first engagement surface is in direct physical contact with at least a portion of the second engagement surface.

Clause 50. The pressure regulator assembly of any of clauses 41-49, wherein the at least one slot is a plurality of slots spaced apart from each other about the longitudinal axis.

Clause 51. The pressure regulator assembly of any of clauses 41-50, wherein the first member has a first hollow body with a proximal end spaced apart from a distal end along the longitudinal axis, with a first inner cavity extending within the first hollow body between the proximal end and the distal end.

Clause 52. The pressure regulator assembly of any of clauses 41-51, wherein at least a portion of the second member is received within the first inner cavity of the first member.

Clause 53. The pressure regulator assembly of any of clauses 41-52, wherein the first member has a flange that protrudes in a radially outward direction relative to the first hollow body at the proximal end.

Clause 54. The pressure regulator assembly of any of clauses 41-53, further comprising at least one gripping member protruding radially outward relative to an outer surface of the hollow body.

Clause 55. The pressure regulator assembly of any of clauses 41-54, wherein the first member and the second member are arranged coaxially with the longitudinal axis.

Clause 56. The pressure regulator assembly of any of clauses 41-55, wherein the second member has a hollow body with a proximal end spaced apart from a distal end along the longitudinal axis, with an inner cavity extending within the hollow body between the proximal end and the distal end.

Clause 57. The pressure regulator assembly of any of clauses 41-56, wherein the hollow body has a radially outwardly protruding projection between the proximal end and the distal end, and wherein the second engagement surface is defined on the projection.

Clause 58. The pressure regulator assembly of any of clauses 41-57, wherein the projection has at least one opening extending therethrough, and wherein the first end of the at least one deflectable beam is connected to a sidewall of the at least one opening.

Clause 59. The pressure regulator assembly of any of clauses 41-58, wherein the proximal end of the hollow body has a keyed opening configured for engaging a threaded screw of a bypass assembly.

Clause 60. The pressure regulator assembly of any of clauses 41-59, further comprising a locking ring positioned within a groove on an inner surface of the hollow body, wherein the locking ring is configured for retaining the second member in a fixed axial position relative to the first member.

Clause 61. The pressure regulator assembly of any of clauses 41-60, wherein the locking ring is a snap ring.

Although the disclosure has been described in detail for the purpose of illustration based on what are currently considered to be the most practical and preferred embodiments, it is to be understood that such detail is solely for that purpose and that the disclosure is not limited to the disclosed embodiments, but, on the contrary, is intended to cover modifications and equivalent arrangements that are within the spirit and scope of the appended claims. For example, it is to be understood that the present disclosure contemplates that, to the extent possible, one or more features of any embodiment or aspect can be combined with one or more features of any other embodiment or aspect.

What is claimed is:

1. A bypass knob for a pressure regulator configured for use with a facemask of a breathing apparatus, the bypass knob comprising:

a first member having a first engagement surface;

a second member having a second engagement surface positioned opposite the first engagement surface;

at least one slot on the first engagement surface of the first member; and at least one deflectable beam on the second engagement surface of the second member, the at least one deflectable beam having a first end connected to the second member and a second, free end opposite the first end, wherein the second end has a latch protruding from the second engagement surface such that the latch is receivable within the at least one slot, wherein the first member and the second member are configured for rotating about a longitudinal axis, wherein, when the first member is rotated in a first direction about the longitudinal axis via a first rotational torque, the latch of the at least one deflectable beam is engaged with the at least one slot to rotate the second member with the first member, and wherein, when the first member is rotated in the first direction via a second rotational torque higher than the first rotational torque, the second end of the at least one deflectable beam is deflected from a first, undeflected position to a second deflected position whereby the latch is disengaged from the at least one slot such that the first member rotates relative to the second member.

2. The bypass knob of claim 1, wherein the latch has an angled surface that engages a first edge or wall of the at least one slot when the latch is received within the at least one slot and when the first member is rotated in the first direction.

3. The bypass knob of claim 2, wherein the latch has a normal surface opposite the angled surface, and wherein the normal surface engages a second edge or wall of the at least one slot when the latch is received within the at least one slot and when the first member is rotated in a second direction opposite the first direction.

4. The bypass knob of claim 1, wherein the first engagement surface and the second engagement surface are arranged substantially perpendicular to the longitudinal axis.

5. The bypass knob of claim 1, wherein the first member and the second member are arranged coaxially with the longitudinal axis.

6. The bypass knob of claim 1, wherein the second member has a hollow body with a proximal end spaced apart from a distal end along the longitudinal axis, with an inner cavity extending within the hollow body between the proximal end and the distal end.

7. The bypass knob of claim 6, wherein the hollow body has a radially outwardly protruding projection between the proximal end and the distal end, and wherein the second engagement surface is defined on the projection.

8. The bypass knob of claim 7, wherein the projection has at least one opening extending therethrough, and wherein the first end of the at least one deflectable beam is connected to a sidewall of the at least one opening.

9. The bypass knob of claim 6, further comprising a locking ring positioned within a groove on an inner surface of the hollow body, wherein the locking ring is configured for retaining the second member in a fixed axial position relative to the first member.

10. The bypass knob of claim 9, wherein the locking ring is a snap ring.

11. A self-contained breathing apparatus (SCBA) comprising:

at least one air tank having at least one air hose extending therefrom;

a pressure regulator assembly having a bypass assembly in fluid communication with the at least one air tank via the at least one air hose; and a facemask connected to the pressure regulator and configured for removable attachment to a head of a user, wherein the bypass assembly comprises a bypass housing and a bypass knob, the bypass knob comprising:

a first member having a first engagement surface;

a second member having a second engagement surface positioned opposite the first engagement surface;

at least one slot on the first engagement surface of the first member; and at least one deflectable beam on the second engagement surface of the second member, the at least one deflectable beam having a first end connected to the second member and a second, free end opposite the first end, wherein the second end has a latch protruding from the second engagement surface such that the latch is receivable within the at least one slot, wherein the first member and the second member are configured for rotating about a longitudinal axis, wherein, when the first member is rotated in a first direction about the longitudinal axis via a first rotational torque, the latch of the at least one deflectable beam is engaged with the at least one slot to rotate the second member with the first member, and wherein, when the first member is rotated in the first direction via a second rotational torque higher than the first rotational torque, the second end of the at least one deflectable beam is deflected from a first, undeflected position to a second deflected position whereby the latch is disengaged from the at least one slot such that the first member rotates relative to the second member.

12. The SCBA of claim 11, wherein the bypass housing has a bypass inlet, a bypass outlet, a fluid passage extending between the bypass inlet and the bypass outlet, and a rod configured to engage a valve assembly of the pressure regulator to regulate a passage of air from the at least one air tank through the pressure regulator.

13. The SCBA of claim 11, wherein rotation of the bypass knob adjusts a rate of air flow through the bypass assembly.

14. The SCBA of claim 11, wherein the latch has an angled surface that engages a first edge or wall of the at least one slot when the latch is received within the at least one slot and when the first member is rotated in the first direction.

15. The SCBA of claim 14, wherein the latch has a normal surface opposite the angled surface, and wherein the normal surface engages a second edge or wall of the at least one slot when the latch is received within the at least one slot and when the first member is rotated in a second direction opposite the first direction.

16. A pressure regulator assembly for a facemask of a self-contained breathing apparatus, the pressure regulator assembly comprising:

a housing defining a first chamber in fluid communication with an inlet and a second chamber in fluid communication with an outlet;

a valve assembly disposed between the first chamber and the second chamber; and a bypass assembly connected to the housing and operatively engaged with the valve assembly, the bypass assembly comprising a bypass housing and a bypass knob, the bypass knob comprising:

a first member having a first engagement surface;

a second member having a second engagement surface positioned opposite the first engagement surface;

at least one slot on the first engagement surface of the first member; and at least one deflectable beam on the second engagement surface of the second member, the at least one deflectable beam having a first end connected to the second member and a second, free end opposite the first end, wherein the second end has a latch protruding from the second engagement surface such that the latch is receivable within the at least one slot, wherein the first member and the second member are configured for rotating about a longitudinal axis, wherein, when the first member is rotated in a first direction about the longitudinal axis via a first rotational torque, the latch of the at least one deflectable beam is engaged with the at least one slot to rotate the second member with the first member, and wherein, when the first member is rotated in the first direction via a second rotational torque higher than the first rotational torque, the second end of the at least one deflectable beam is deflected from a first, undeflected position to a second deflected position whereby the latch is disengaged from the at least one slot such that the first member rotates relative to the second member.

17. The pressure regulator assembly of claim 16, wherein the bypass housing has a bypass inlet, bypass outlet, a fluid passage extending between the bypass inlet and the bypass outlet, and a rod configured to engage the valve assembly of the pressure regulator to regulate a passage of air from the at least one air tank through the pressure regulator.

18. The pressure regulator assembly of claim 16, wherein rotation of the bypass knob adjusts a rate of air flow through the bypass assembly.

19. The pressure regulator assembly of claim 16, wherein the latch has an angled surface that engages a first edge or wall of the at least one slot when the latch is received within the at least one slot and when the first member is rotated in the first direction.

20. The pressure regulator assembly of claim 19, wherein the latch has a normal surface opposite the angled surface, and wherein the normal surface engages a second edge or wall of the at least one slot when the latch is received within the at least one slot and when the first member is rotated in a second direction opposite the first direction.

* * * * *